US006280305B1

(12) United States Patent
Donatelli et al.

(10) Patent No.: US 6,280,305 B1
(45) Date of Patent: Aug. 28, 2001

(54) VIBRATION SURFACE FINISHING APPARATUS

(76) Inventors: Rosalie Donatelli, 2005 Westfield Ave; Joeseph M. Donatelli, Sr.; Joseph M. Donatelli, both of 2527 Tack Cir.; Thomas P. A. Donatelli, 2523 Tack Cir., all of Scotch Plains, NJ (US) 07076

( * ) Notice: Subject to any disclaimer, the term of this patent is extended or adjusted under 35 U.S.C. 154(b) by 0 days.

(21) Appl. No.: 09/431,886

(22) Filed: Nov. 2, 1999

(51) Int. Cl.[7] ..... B24B 7/00

(52) U.S. Cl. ..... 451/270; 451/70; 451/271; 451/296; 451/306; 451/336; 451/450; 408/236; 408/237

(58) Field of Search ..... 451/70, 270, 271, 451/296, 306, 336, 450; 408/236, 237

(56) References Cited

U.S. PATENT DOCUMENTS 4,125,057 * 11/1978 Cox ..... 409/74
5,667,428 * 9/1997 Lunn ..... 451/70
5,733,175 * 3/1998 Leach ..... 451/41
5,971,677 * 10/1999 Lan ..... 408/236

* cited by examiner

*Primary Examiner*—Derris H. Banks
*Assistant Examiner*—Shantese McDonald
(74) *Attorney, Agent, or Firm*—McGlew and Tuttle, P.C.

(57) ABSTRACT

An orbiting head is rotatably mounted in the housing. The orbiting head has an axial end with a grinding surface for contact with the workpiece having its surface finished. The orbiting head defines a fluid passage with one end having an opening at the grinding surface. A spindle arbor is connected to the orbiting head and rotates with the orbiting head. The spindle arbor also defines a passage having one end connected to the passage of the orbiting head, and having another end connected to a fluid source. A drive is connected to the spindle arbor for driving the spindle arbor and the orbiting head in rotation. The orbiting head is rotated, and the grinding surface is placed into contact with the surface of the workpiece, and in relative rotation to the surface of the workpiece. Fluid is then moved through the passages from the fluid source to the opening in the grinding surface, and from the opening to an area between the grinding surface and the workpiece. This moving fluid carries away the removed portions of the workpiece and prevents clogging of the grinding surface. Since the grinding surface is not clogged, the grinding surface operates very efficiently and uniformly. Also the fluid, preferably water, allows for more uniform movement of the grinding surface with respect to the workpiece.

20 Claims, 4 Drawing Sheets

VIBRATION SURFACE FINISHING APPARATUS

FIELD OF THE INVENTION

The present invention relates to devices for smoothing the surface of a workpiece, and in particular to abrading a workpiece with a vibrating and rotating surface.

BACKGROUND OF THE INVENTION

Many furnishings, such as those used in the home and office, are desired with surfaces that are very smooth. Table tops and counters are often desired to have a very smooth surface, such as a highly polished surface, particularly for sanitary and aesthetic purposes. Many devices and methods are known for producing a very smooth finish on a table or counter top. A workpiece for a table or counter top, can either be made with a smooth finish, or the surface can be treated to produce the smooth surface.

A common method for smoothing a rough workpiece, is to move an abrasive over the surface of the workpiece in order to wear down the surface of the workpiece. This wearing down, first removes raised portions of the surface which cause the roughness. These removed portions, need to be removed from the abrasive, so that they do not clog the abrasive and reduce the effectiveness of the abrasive. The removed portions of the workpiece form a dust. This dust often becomes airborne and can cause health problems, as well as interfere with the finishing operation, and interfere with the surrounding environment.

Because a smooth surface requires very little variation between the high and low points on the surface, the abrasive material must be course to fine in order to achieve the desired smoothness. For very smooth surfaces, the abrasive particles must be very fine and can only remove a very small amount of workpiece surface with each movement. A very smooth surface thus requires much relative movement between the abrasive and the workpiece. Also the relative movement must be applied evenly across the entire surface to have a uniform finish and to have the surface be substantially flat. The large number of repetitive motions, as well as the need to have a uniform and flat surface, causes surface finishing to be very labor intensive, especially for large surfaces.

New materials for table and counter tops, such as CORIAN® are very desirable, and are known as solid surface materials. This solid surface material is manufactured most economically in large surface areas, and with a rough surface. Because of the large amount of labor needed to smooth the surface, and the high level of skill required to perform a uniform flat surface, surface finishing is usually only performed once the workpiece has been cut to its final size. Even then surface finishing is a significant task. Surface finishing needs to be done at those facilities where the individual pieces of furniture are manufactured. This requires a sizable investment by a furniture manufacture and contributes to the final cost of a piece of furniture.

SUMMARY AND OBJECTS OF THE INVENTION

It is the object of the present invention to provide an apparatus which can economically provide a very smooth surface to a very large workpiece, where the surface is smooth and uniform, and the effects of dust caused by removal of portions of the workpiece is eliminated.

The present invention accomplishes this main object by providing an apparatus with a housing and an orbiting head rotatably mounted in the housing. The orbiting head has an axial end with a grinding surface for contact with the workpiece having its surface finished. The grinding surface is formed of abrasives. The orbiting head defines a fluid passage with one end having an opening at the grinding surface. A spindle arbor is connected to the orbiting head and rotates with the orbiting head. The spindle arbor also defines a passage having one end connected to the passage of the orbiting head, and having another end connected to a fluid source. A drive means is connected to the spindle arbor for driving the spindle arbor and the orbiting head in rotation. The orbiting head is rotated, and the grinding surface is placed into contact with the surface of the workpiece in relative rotation to the surface of the workpiece. Fluid is then moved through the passages from the fluid source to the opening in the grinding surface, and from the opening to an area between the grinding surface and the workpiece. This moving fluid carries away the removed portions of the workpiece and prevents clogging of the grinding surface. Since the grinding surface is not clogged, the grinding surface operates very efficiently and uniformly. Also the fluid, preferably water, allows for more uniform movement of the grinding surface with respect to the workpiece. The fluid flow therefore provides for a finishing of the workpiece that is more uniform, and/or less labor intensive. The fluid also entrains the removed dust, and provides for a healthier, safer and more pleasant work environment. The present invention also has a vibration means for vibrating the head during the rotation. This removes swirl marks which are caused when the relative motion between the grinding surface and the workpiece is always circular.

A housing holds the orbiting head and spindle arbor, and the housing itself is connected to an arm which is preferably formed of first and second linkages. It is possible for the arm to just be a single linkage. One end of the arm is fixed to the housing, and the other end is pivotable on a pivot point which is preferably located on a fixed stand. In the case of two linkages, one linkage is fixed to the housing on one end and the other end is fixed to a first end of a second linkage. The other end of the second linkage is then pivoted on a stand. The drive motor can be at the pivot point, or at the link point between the two linkages. A transmission then connects the motor to the spindle arbor. The pivoting axis of the pivot point and linkage point are substantially parallel to the rotational axis of the orbiting head. The two linkage arrangement is preferred, since it allows substantially unrestricted movement of the orbiting head in the plane of the workpiece surface.

The housing, the arm and the stand can be locked with respect to axial movement. The orbiting head is preferably axially movable in the housing, and a force means biases the orbiting head axially away from the housing with a force that is selectable by the operator. In this way, the operator can desire the amount of force that the grinding surface applies to the workpiece, and this force is maintained wherever the operator moves the orbiting head. It is also preferable that the force means vary the set force based on a distance of the orbiting head from the housing. In this way, if there is a portion of the workpiece which is higher than the surrounding areas, the force means will apply more force on this higher area which will tend to lower the higher area and even out the surface. This force means preferably includes an air cylinder and a control means for controlling an amount of air in the air cylinder.

An operator is then able to easily move the grinding surface over large areas, while always maintaining the same amount of pressure, to quickly remove material from the solid surface and quickly form a very smooth, uniform and flat surface. The present invention makes it economical to form a very smooth surface finish on the large areas of the solid surface immediately after the solid surface has been formed. Individually processing smaller workpieces in distributive facilities is therefore no longer necessary.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
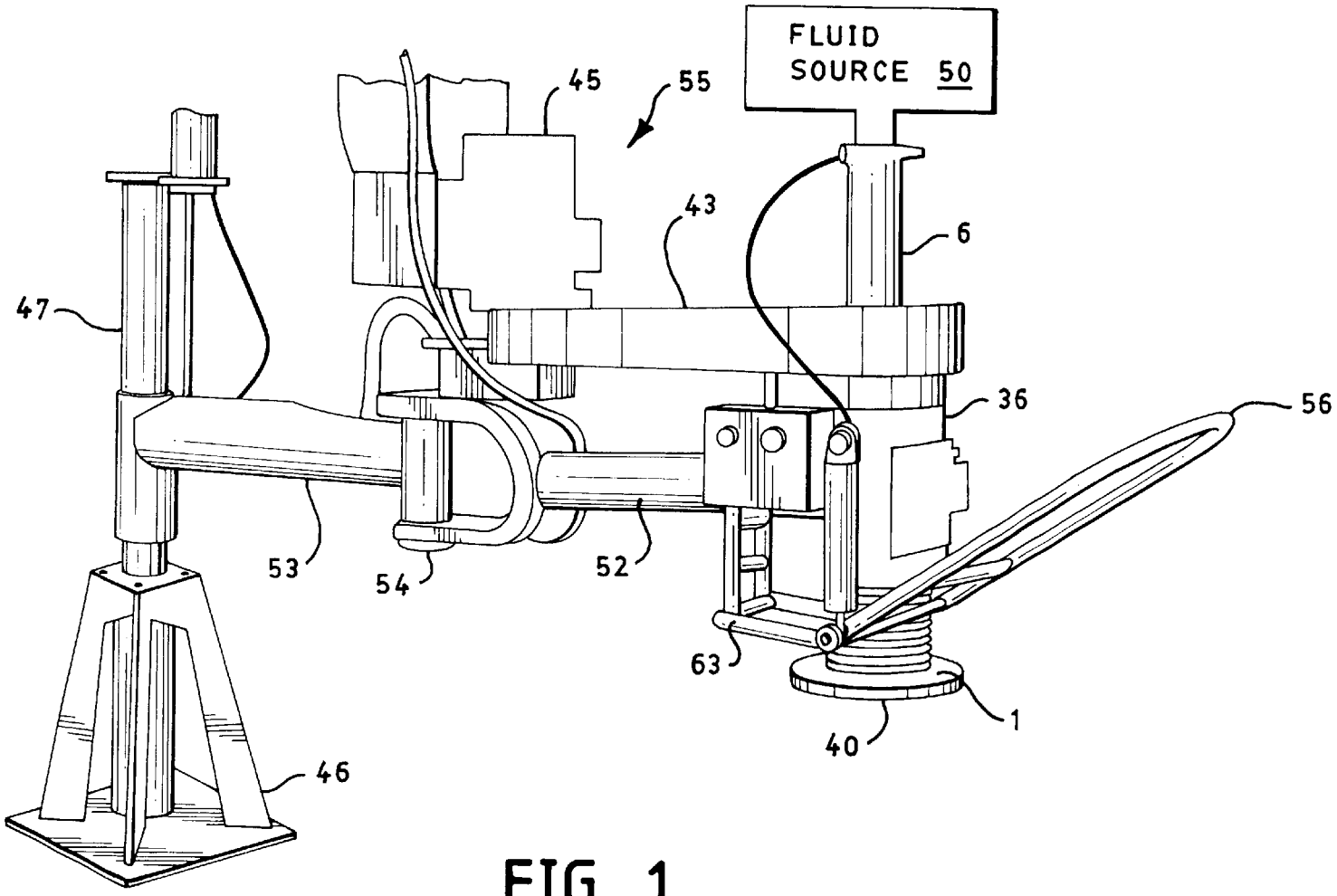
FIG. 1 is a side view of the present invention.
Figure 2:
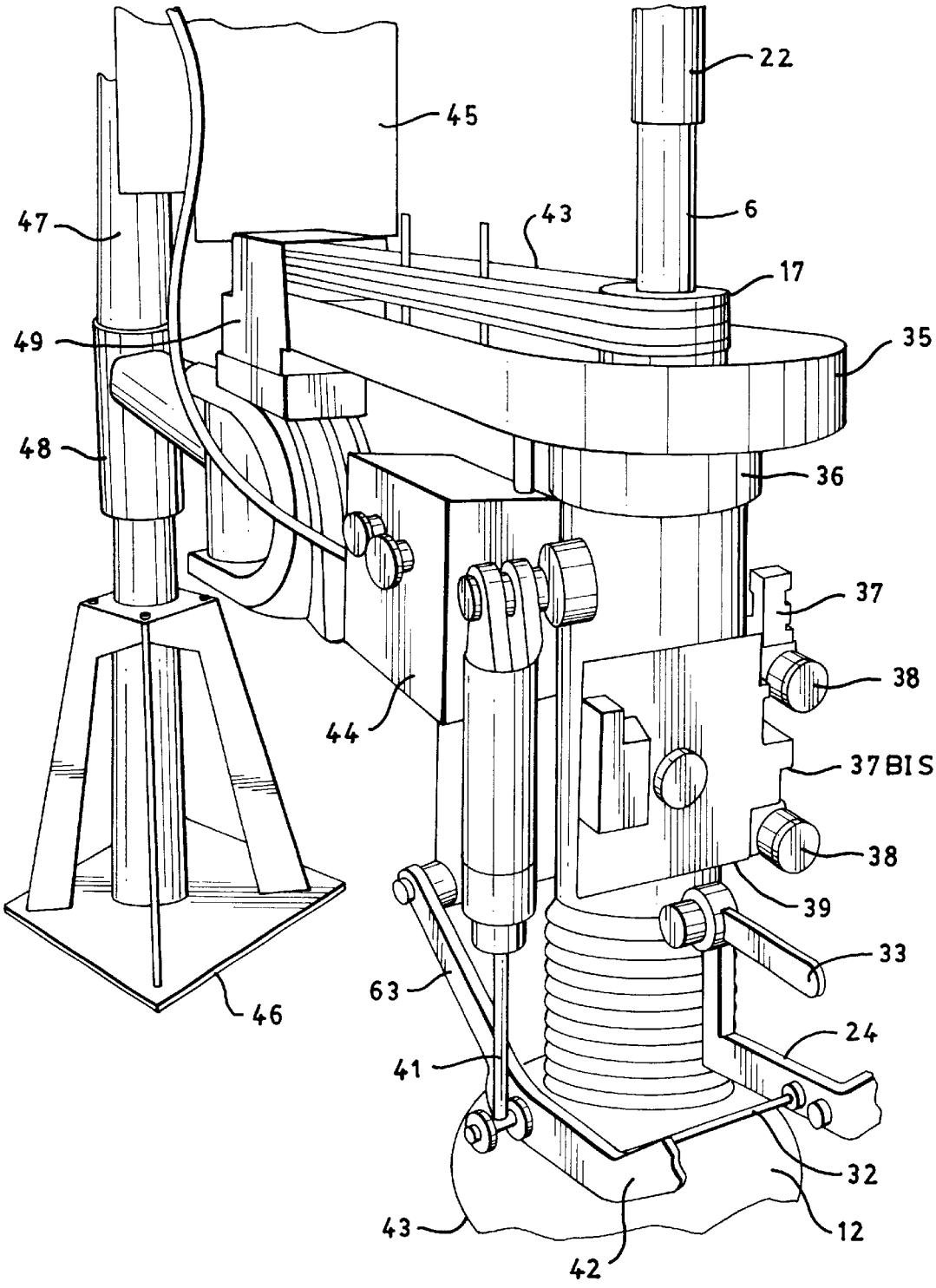
FIG. 2 is a perspective view of the present invention.
Figure 4:
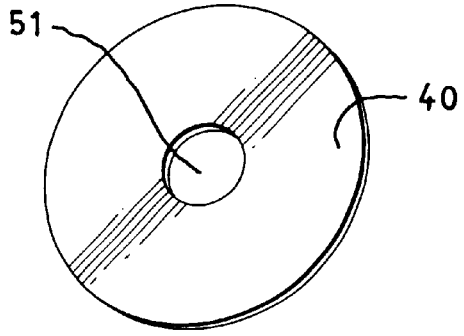
FIG. 4 is a view of the grinding surface.

Referring to the drawings, in particular to FIG. 1, the present invention comprises a housing 36 in which is rotatably mounted a orbiting head 1 which has a grinding surface 40 on one axial end thereof. Also in the housing 36 is a spindle arbor 6 which is rotatably mounted in the housing 36. One end of the spindle arbor 6 is connected to, and rotates with, the orbiting head 1. The other end of the spindle arbor 6 is connected to a fluid source 50. The spindle arbor 6 and the orbiting head 1 define a passage between an opening 51 in the grinding surface 40 and the fluid source 50. The fluid source flows fluid, preferably water, through the passages of the spindle arbor 6 and orbiting head 1 so that the fluid flows out of the opening 51 in the grinding surface 40. The fluid source 50 then flows the fluid between the grinding surface 40 and the surface of a workpiece to be finished.

The housing 36 is connected to a first linkage 52. Another end of the first linkage 52 is connected to one end of a second linkage 53 at a linkage point 54. The first and second linkages 52, 53 are pivotally connected at the linkage point 54 about a linkage point axis.

The other end of second linkage 53 is pivotally connected to a pivot point 47 on a stand 46. The housing 36, the first and second linkages 52 and 53 are pivotable on the pivot point 47 about a pivot axis. The pivot axis, the link axis, and an axis of rotation of the orbiting head 1 are all substantially parallel and are shown vertically in the drawings.

The present invention contains a drive 55 which rotates the spindle arbor 6 and the orbiting head 1. The drive includes a motor 45 and a transmission 43 connecting the motor 45 to the spindle arbor 6. The motor 45 is preferably mounted on the linkages in the vicinity of the linkage point 54. The transmission 43 is preferably formed with a plurality of belts.

Figure 3:
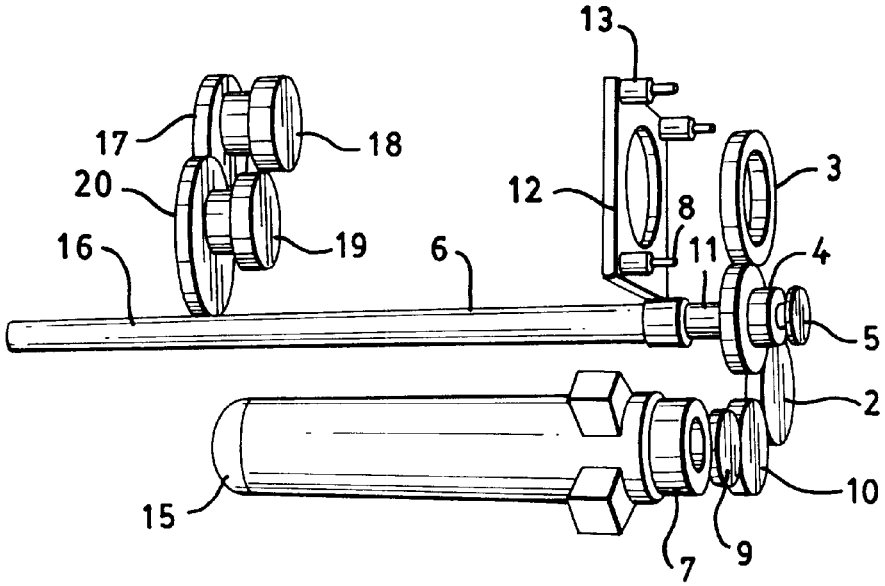
FIG. 3 is a view of the vibration means of the present invention.
Figure 5:
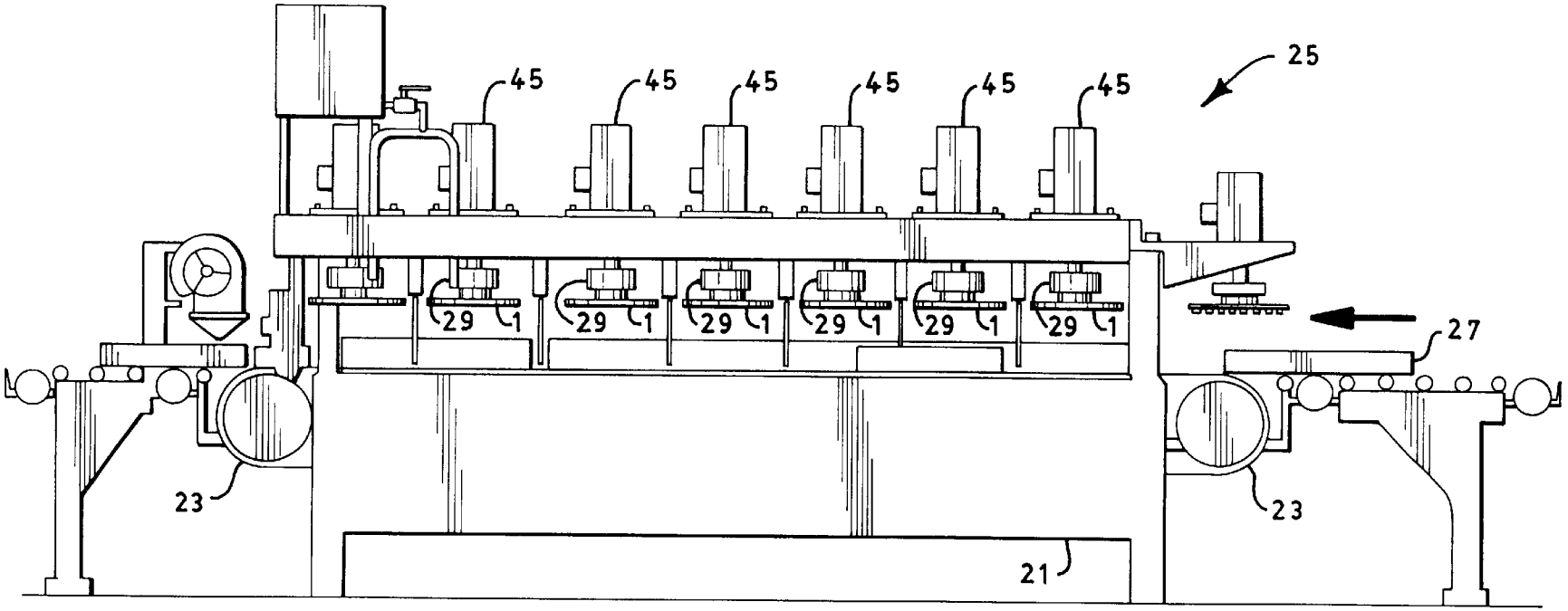
FIG. 5 is a view of a plurality of orbiting heads in a belt machine.

The housing 36 contains a vibration means. FIG. 3 shows the various cam parts 2–5 and 7–20 which act upon the spindle arbor 6 to vibrate the orbiting head, preferably in the plane of the surface to be finished. The vibrating path formed by the parts 2–5 and 7–20 is chosen so that swirl marks are not formed in the surface finished. Vibration means for preventing swirl marks are well known in the art and further explanation of this structure is not within the scope of the present invention.

The orbiting head 1 is also held to be axially movable in the housing 36 through head linkage 63. A force means biases the orbiting head axially away from the housing with a force that is selectable by the operator. The housing 36, the first and second linkages 52, 53, the pivot point 47 and the stand 46 are preferably axially fixed with respect to each other. It is possible to have the second linkage 53 axially movable on the pivot point 47 in a selective manner. The height of the linkages 52, 53 and the housing 36 on the pivot point 47 can be adjusted, and then locked into the desired position. The force means, preferably embodied by an air cylinder 41 and head linkage 63 can then maintain a constant pressure of the grinding surface 40 on the surface of the workpiece.

It is also possible for the force means to vary the force based on the distance of the orbiting head from the housing. The closer the orbiting head 1 is to the housing 36, the greater the force. In this way, high spots on the surface of the workpiece experience a higher pressure and are subsequently more abraded than low areas. The force means includes a control means 37 for controlling an amount of air in the air cylinder 41, and the control means 37 includes gauges 38 indicating an amount of air in the air cylinder 41. experience a higher pressure and are subsequently more abraded then low areas. The force means includes a control means 37 for controlling an amount of air in the air cylinder 41, and the control means 37 includes gauges 38 indicating an amount of air in the air cylinder 41.

A handle 56 can be held by the operator, to move the orbiting head and the housing 36 back and forth, and forwards and backwards, across the surface of the workpiece.

A plurality of the orbiting heads 1 can be placed in the frame 21 of a belt machine. Each of the orbiting heads 1 has its own motor 45. In an alternative, a single motor 45 and appropriate linkages could form the drive means for each of the orbiting heads. A conveyor belt 23 moves a workpiece 27 sequentially into contact with the plurality of orbiting heads 1. A vibration means 29 is connected to each of the orbiting heads 1 to vibrate the orbiting head 1 in a path to prevent the orbiting head 1 from forming swirl marks in the workpiece 27. Preferably each of the orbiting heads 1 has its own vibration means 29. Also preferably, a coarseness of the orbiting heads 1 varies from coarse to fine in a direction of travel of the conveyor belt 23. The orbiting head 1 and grinding surface 40 can have the fluid passage connected to the fluid source for moving fluid through the passages of the orbiting head and between the grinding surface 40 and the workpiece 27.

The present invention is able to grind and polish by vibrating solid surfaces under water, and thus eliminating dry sanding dust and creating smooth finishes rather than swirls that occur with conventional grinding. The orbiting head is connected by the housing and the linkages to form a swing arm machine for doing large sections or be adapted to belt line machines with multiple grinding and polishing heads. The rigid head on the swing arm machine of the present invention can guarantee a smooth surface across the entire workpiece. The orbiting head 1 can be swung in any direction so that an operator can concentrate on a particular rough spot. The linkages and force means guarantee that all areas of the workpiece can be finished as needed and be finished according to the same characteristics.

While specific embodiments of the invention have been shown and described in detail to illustrate the application of the principles of the invention, it will be understood that the invention may be embodied otherwise without departing from such principles.

What is claimed is:

1. A surface finishing apparatus comprising:

a housing;

a orbiting head rotatably mounted in said housing, said orbiting head having an axial end with a grinding surface for contact with a workpiece to be surface finished, said orbiting head defining a fluid passage having an end opening in said grinding surface and said fluid passage passing through said grinding surface;

a spindle arbor rotatably mounted in said housing and having a first end connected to said orbiting head, said spindle arbor having a second end connectable to a fluid source, said spindle arbor defining a passage communicating said second end to said passage of said orbiting head;

drive means connected to said spindle arbor and for driving said spindle arbor and said orbiting head in rotation.

2. The apparatus in accordance with claim 1, wherein:

said passage of said orbiting head and said passage of said spindle arbor are substantially concentric with an axis of rotation of said orbiting head and said spindle arbor;

said end opening is arranged in a substantial center of said grinding surface.

3. The apparatus in accordance with claim 1, further comprising:

a fluid source connected to said second end of said spindle arbor and for moving fluid through said passages of said orbiting head and said spindle arbor, through said opening in said grinding surface, and between said grinding surface and the workpiece in contact with the grinding surface.

4. The apparatus in accordance with claim 1, further comprising:

an arm having a first end connected to said housing and a second end pivotally connectable to a pivot point, said arm and said housing being pivotal on the pivot point about a pivot point axis.

5. The apparatus in accordance with claim 4, wherein:

an axis of rotation of said orbiting head is substantially parallel to said pivot point axis.

6. The apparatus in accordance with claim 4, wherein:

said drive means includes a motor positioned at said pivot point and includes a transmission connecting said motor to said spindle arbor.

7. The apparatus in accordance with claim 4, wherein:

said arm includes first and second linkages, said first linkage having a first end connected to said housing and having a second end pivotally connected to a first end of said second linkage at a linkage point, said second linkage having a second end pivotally connectable to said pivot point.

8. The apparatus in accordance with claim 7, wherein:

a pivot axis of said linkage point is substantially parallel to an axis of rotation of said orbiting head and said pivot point axis.

9. The apparatus in accordance with claim 7, wherein:

said drive means includes a motor positioned at said linkage point and includes a transmission connecting said motor to said spindle arbor.

10. The apparatus in accordance with claim 4, wherein:

said arm is fixed to said housing;

a stand forms said pivot point at said second end of said arm.

11. The apparatus in accordance with claim 10, wherein:

said orbiting head is axially movable with respect to said housing;

a force means biases said orbiting head axially away from said housing with a selectable force;

said arm and said stand are axially fixed to said housing;

said selectable force is variable based on a distance of said orbiting head from said housing.

12. The apparatus in accordance with claim 1, further comprising:

a fluid source connected to said second end of said spindle arbor and for moving fluid through said passages of said orbiting head and said spindle arbor, through said opening in said grinding surface;

said opening directing the fluid directly between said grinding surface and the workpiece in contact with the grinding surface.

13. A surface finishing apparatus comprising:

a housing;

a orbiting head rotatably mounted in said housing, said orbiting head having an axial end with a grinding surface for contact with a workpiece to be surface finished;

a spindle arbor rotatably mounted in said housing and connected to said orbiting head;

drive means connected to said spindle arbor and for driving said spindle arbor and said orbiting head in rotation;

first and second linkages, said first linkage having a first end connected to said housing and having a second end pivotally connected to a first end of said second linkage at a linkage point, said second linkage having a second end pivotally connectable to a pivot point, said linkages and said housing being pivotal on the pivot point about a pivot point axis, said drive means includes a motor positioned at said linkage point and includes a transmission connecting said motor to said spindle arbor.

14. The apparatus in accordance with claim 13, wherein:

a pivot axis of said linkage point is substantially parallel to an axis of rotation of said orbiting head and said pivot point axis.

15. The apparatus in accordance with claim 13, wherein:

said arm is fixed to said housing;

a stand forms said pivot point at said second end of said arm;

vibration means is located in said housing for vibrating said orbiting head in a path to prevent said grinding surface from forming swirl marks in the workpiece.

16. The apparatus in accordance with claim 15, wherein:

said orbiting head is axially movable in said head;

force means biases said orbiting head axially away from said housing with a selectable force.

17. The apparatus in accordance with claim 16, wherein:

said arm and said stand are axially fixed to said housing;

said selectable force is variable based on a distance of said orbiting head from said housing;

said force means includes an air cylinder and control means for controlling an amount of air in said air cylinder.

18. A surface finishing apparatus comprising:

a frame;

a conveyer belt for transporting a workpiece through said frame;

a plurality of orbiting heads arranged in said fame and movable into contact with a surface of the workpiece;

each of said orbiting heads being connected to a drive for driving said orbiting head in rotation;

each of said orbiting heads being connected to a vibration means for vibrating said orbiting head in a path to prevent said orbiting head from forming swirl marks in the workpiece.

19. The in accordance with claim 18, wherein:

said orbiting head has an axial end with a grinding surface for contact with the surface of the workpiece, said orbiting head defining a fluid passage having an end opening at said grinding surface;

said each orbiting head is connected to a respective said drive means by a spindle arbor, said spindle arbor having a first end connected to said orbiting head, said spindle arbor having a second end, said spindle arbor defining a passage communicating said second end to said passage of said orbiting head, said passage of said orbiting head and said passage of said spindle arbor are substantially concentric with an axis of rotation of said orbiting head and said spindle arbor;

a fluid source is connected to said second end of said spindle arbor and for moving fluid through said passages of said orbiting head and said spindle arbor, through said opening in said grinding surface, and between said grinding surface and the workpiece in contact with the grinding surface.

20. A surface finishing apparatus comprising:

a housing;

a orbiting, head rotatably mounted in said housing, said orbiting head having an axial end with a grinding surface for contact with a workpiece to be surface finished, said orbiting head defining a fluid passage having an end opening at said grinding surface;

a spindle arbor rotatably mounted in said housing and having a first end connected to said orbiting head, said spindle arbor having a second end connectable to a fluid source, said spindle arbor defining a passage communicating said second end to said passage of said orbiting head;

drive means connected to said spindle arbor and for driving said spindle arbor and said orbiting head in rotation;

vibration means in said housing for vibrating said orbiting head in a path to prevent said grinding surface from forming swirl marks in the workpiece.

* * * * *